United States Patent [19]

Jiang

[11] Patent Number: 4,940,910

[45] **Date of Patent: * Jul. 10, 1990**

[54] TEMPERATURE COMPENSATED MONOLITHIC DELAY CIRCUIT

[75] Inventor: Ching-Lin Jiang, Dallas, Tex.

[73] Assignee: Dallas Semiconductor Corporation, Dallas, Tex.

[ * ] Notice: The portion of the term of this patent subsequent to Jun. 27, 2006 has been disclaimed.

[21] Appl. No.: 360,511

[22] Filed: Jun. 2, 1989

Related U.S. Application Data

[63] Continuation of Ser. No. 217,142, Jun. 30, 1988, Pat. No. 4,843,265.

[51] Int. Cl.[5] ..... G05F 1/567

[52] U.S. Cl. ..... 307/591; 307/228; 307/246; 307/310; 307/594; 307/296.6; 323/907

[58] Field of Search ..... 307/310, 246, 591, 29 T, 307/601–605, 491, 290, 228, 594, 296.6; 323/312–314, 907

[56] References Cited

U.S. PATENT DOCUMENTS

| | | | |
|---|---|---|---|
| 4,401,898 | 8/1983 | Sommerer | 307/310 |
| 4,746,823 | 5/1988 | Lee | 307/310 |
| 4,843,265 | 6/1989 | Jiang | 307/310 |
| 4,866,301 | 9/1989 | Smith | 307/246 |

*Primary Examiner*—Stanley D. Miller
*Assistant Examiner*—T. Cunningham
*Attorney, Agent, or Firm*—Worsham, Forsythe, Sampels & Wooldridge

[57] ABSTRACT

A temperature and processing compensated time delay circuit of the type which can be fabricated in a monolithic integrated circuit utilizes a field effect transistor (FET) (12) connected to the terminals of a charged capacitor (14). A bias voltage connected to the gate of the FET (12) varies with temperature in a manner to compensate for the changes in current which flows from the capacitor (14) through the FET (12) due to changes in temperature. The bias voltage also varies from one integrated circuit to another in a manner to compensate for variations in FET threshold voltage caused by variations in the processing of the integrated circuits.

21 Claims, 1 Drawing Sheet

TEMPERATURE COMPENSATED MONOLITHIC DELAY CIRCUIT

This is a continuation application Ser. No. 217,142, filed 6/30/88.

TECHNICAL FIELD

This invention relates to delay circuits and more particularly to delay circuits fabricated in monolithic integrated circuits.

BACKGROUND OF THE INVENTION

Delay circuits are used in various electronic circuits for functions such as matching timing delays inside integrated circuits to avoid race conditions, and for device independent time delays. The circuits for generating the device independent time delays are generally either hybrid delay lines which use small discrete L and C elements, or monostable multivibrator integrated circuits or "one shots".

The device independent time delay circuits are designed to be essentially insensitive to variations in ambient temperature, on the order of 1000 parts per million (PPM) per degree Centigrade and in variations of supply voltage. The term "essentially", as used herein, means closely approximating to a degree sufficient for practical purposes.

At present, because of the relative complexity of one shots, the only viable form of device independent delay circuits for providing a plurality of delayed signals from one input signal is the hybrid delay line. However, the hybrid delay lines tend to be expensive to manufacture compared to most integrated circuits, and tend not to be as reliable as monolithic I.C.'s.

It can therefore be appreciated that an independent time delay circuit which is able to provide a plurality of time delays from a single input signal and which can be fabricated using standard integrated circuit fabrication techniques is highly desirable.

SUMMARY OF THE INVENTION

It is therefore an object of the present invention to provide a delay circuit which can be fabricated in a monolithic integrated circuit, which is small enough to be repeated several times in such circuit and which is essentially insensitive to changes in temperature.

As shown in an illustrated embodiment of the invention, a charged capacitor is connected to discharge through a field effect transistor (FET) having a bias voltage applied to the gate terminal thereof. The bias voltage varies with temperature in a manner to effectively compensate for temperature variations in the FET.

A further aspect of the illustrated invention is a circuit for generating a bias voltage for a FET which effectively compensates for temperature variations in the FET and which effectively compensates for differing transistor characteristics from one integrated circuit to another.

Still another aspect of the present invention is a method for generating an essentially temperature stable delay circuit by charging a capacitor to a first voltage and discharging the capacitor through a FET. The temperature stability occurs by compensating for the temperature variations in the FET by generating inverse variations in the FET gate bias voltage.

BRIEF DESCRIPTION OF THE DRAWINGS

The aforementioned and other features, characteristics, advantages, and the invention in general, will be better understood from the following more detailed description taken in conjunction with the accompanying drawings in which.

Figure 1A:
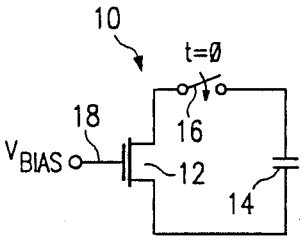
FIG. 1*a* is a schematic diagram of the basic delay circuit according to the present invention.

It will be appreciated that, where considered appropriate, reference numerals have been repeated in both figures to indicate corresponding features.

DESCRIPTION OF THE PREFERRED EMBODIMENTS

The present invention provides a delay circuit in which a charged capacitor is discharged through a field effect transistor (FET). A bias voltage applied to the gate of the FET varies with temperature in a manner to effectively compensate for temperature variations in the FET.

Turning now to the drawings, FIG. 1*a* shows a schematic diagram for the basic timing circuit according to the present invention shown generally as element 10. A field effect transistor designated herein as FET 12 has its source terminal thereof connected to one terminal of a capacitor 14 and its drain terminal connected to a switch 16. The FET 12 is an n-channel enhancement-mode transistor having a threshold voltage to become conductive of typically 0.7 volts. The other side of the switch 16 is connected to the other terminal of the capacitor 14. The gate terminal of the transistor 12 is connected to a bias voltage $V_{BIAS}$ at a node 18.

Figure 1B:
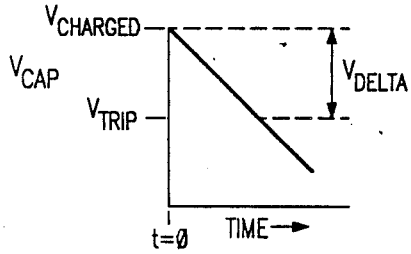
FIG. 1*b* is a plot of the voltage across the capacitor during operation of the circuit of FIG. 1*a;*

The operation of the circuit of FIG. 1*a* will now be described with respect to FIG. 1*b*. Before time t=0 the capacitor 14 is charged to a first voltage shown as $V_{CHARGED}$ in FIG. 1*a*. At time t=0 switch 16 closes, completing the circuit through the FET 12. The bias voltage $V_{BIAS}$ is such that the FET 12 operates in its saturation region and therefore operates essentially as a constant current drain to the capacitor 14. Since the current from the capacitor 14 is constant, the voltage across the capacitor 14 decreases at essentially a constant rate as shown in FIG. 1*b*. A voltage detector not shown in FIG. 1*a* monitors the voltage across the capacitor 14 and provides an output signal when the voltage reaches a trip voltage shown as $V_{TRIP}$ in FIG. 1*b*. The difference between $V_{CHARGED}$ and $V_{TRIP}$ is shown as $V_{DELTA}$ in FIG. 1*b*.

In order for the circuit of FIG. 1*a* to have a time delay which is independent of temperature, the voltage $V_{DELTA}$ must be independent of temperature. This implies that the current through the FET 12 must also be independent of temperature. However, it is well known that the current through an FET is not constant with temperature, but, instead, varies with temperature. In the present invention, compensation for the temperature variations in the FET is achieved by circuitry which provides appropriate changes in the gate-to-source voltage applied to the FET.

The basic (somewhat simplified) formula for current flowing through an FET biased to operate in the saturation region is $$I=u(C_{ox}/2)(W/L)(V_{gate}-V_{th})^2 \quad (1)$$

where u is the surface mobility, $C_{ox}$ is the capacitance per unit area of the gate oxide, W is the width of the FET channel region, L is the length of the FET channel region, $V_{gate}$ is the gate-to-source voltage and $V_{th}$ is the threshold voltage of the FET. If the gate-to-source voltage is set to be equal to a reference voltage plus a threshold voltage ($V_{ref}+V_{th}$) then equation (1) becomes $$I=u(C_{ox}/2)(W/L)(V_{ref})^2 \quad (2)$$

For the capacitor 14 of FIG. 1*a*, the time T for the capacitor 14 to discharge a voltage $V_{DELTA}$ is given by the formula $$T=(CV_{DELTA})/I \quad (3)$$

where C is the capacitance of the capacitor and I is the current flowing from the capacitor. For a capacitor formed in a monolithic integrated circuit, the capacitance is given by $$C=C_{ox}A \quad (4)$$

where $C_{ox}$ is the capacitance per unit area of the oxide layer and A is the area of the capacitor. Combining equations (2), (3) and (4) together provides $$T=(2AV_{DELTA})/((W/L)uV_{ref}^2). \quad (5)$$

An examination of equation (5) reveals that all of the terms are, or can be made, temperature independent except for u, the surface mobility term. The present invention compensates for the variations in u by providing compensating variations in the term $V_{ref}$ in equation (5).

It has been found, for the wafer processing used to manufacture integrated circuits of the type used to embody the present invention, and for a first order approximation, that u decreases linearly as the temperature increases. Accordingly if u has a relative value of 1.000 at zero degrees Centigrade, then it will have a relative value of 0.832 at 55 degrees Centigrade (273/328), and a relative value of 0.773 at 80 degrees Centigrade (273/353). If the term u $V_{ref}$ is made to be independent of temperature, then equation (5) can be made to be independent of temperature. In other words, if the value of u at 55 degrees relative to the value of u at zero degrees times the value of $V_{ref}^2$ at 55 degrees relative to the value of $V_{ref}^2$ at zero degrees is equal to one, and similarly for 80 degrees Centigrade, then the time delay T will be independent of temperature to a first order approximation. Therefore, the relative value of $V_{ref}$ at 55 degrees Centigrade must be equal to the square root of the inverse of 0.832 or 1.096. Similarly, the relative value of $V_{ref}$ at 80 degrees must be 1.137.

From the above it is evident that $V_{ref}$ must increase with temperature in a nonlinear manner. It was found that an equation of the form $V_1-K_2V_{be}$ will provide a fairly accurate fit to the above requirements if the parameters $V_1$ and $K_2$ are chosen properly. The term $V_1$ represents a reference voltage that is essentially independent of power supply voltage variations and of temperature variations, and $V_{be}$ represents the normal base-emitter voltage drop of a bipolar transistor operating in its active region (i.e., not in cutoff or saturation). In the preferred embodiment the value of $V_1$ was selected as 3.775 volts, and the value of $K_2$ was selected as 3.

Figure 1C:
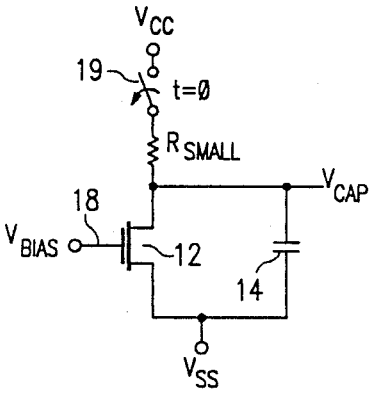
FIG. 1*c* is a preferred embodiment of the present invention of the schematic diagram of FIG. 1*a;*

The circuit shown in FIG. 1*a* is, in the present invention, preferably embodied by a similar circuit shown in FIG. 1*c*. As shown in FIG. 1*c* the two terminals of the capacitor 14 and the source and drain of the FET 12 are connected in parallel, respectively, without a switch between them. The source of the FET 12 is connected to $V_{SS}$. Connected to the drain of FET 12 is a resistor $R_{SMALL}$, the other side of which is connected to one terminal of a switch 19, while the other terminal of the switch 19 is connected to $V_{CC}$. $V_{CC}$ is the normal supply voltage to the integrated circuit that embodies the present invention and typically is at 5 volts. In operation the FET 12 is made always conductive by the bias voltage $V_{BIAS}$. When the switch 19 is closed, the capacitor 14 is charged to approximately $V_{CC}$ through $R_{SMALL}$. Although the FET 12 is also conductive at this time, the drain-to-source resistance of the FET 12 is much greater than the resistance of $R_{SMALL}$. When the switch 19 is open, then the voltage on the capacitor is discharged through the FET 12 as described above. For an alternate embodiment, a tighter delay tolerance can advantageously be obtained by connecting the switch 19 to a regulated power supply node that has a tighter voltage tolerance than is generally conventional for the normal supply voltage $V_{CC}$.

Figure 2B:
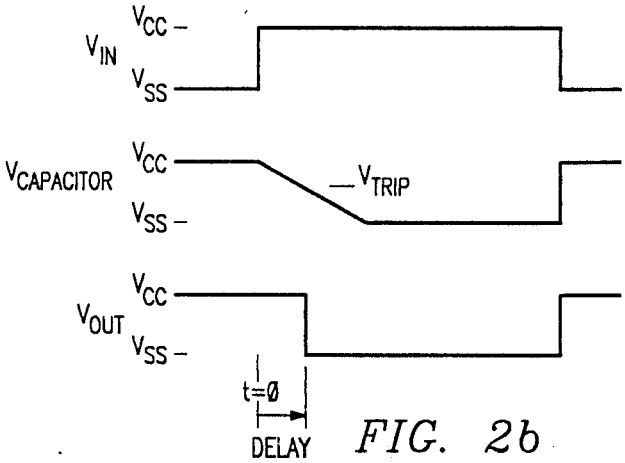
FIG. 2*b* is a plot of the input voltage versus the output voltage for the circuit of FIG. 2*a.*
Figure 2A:
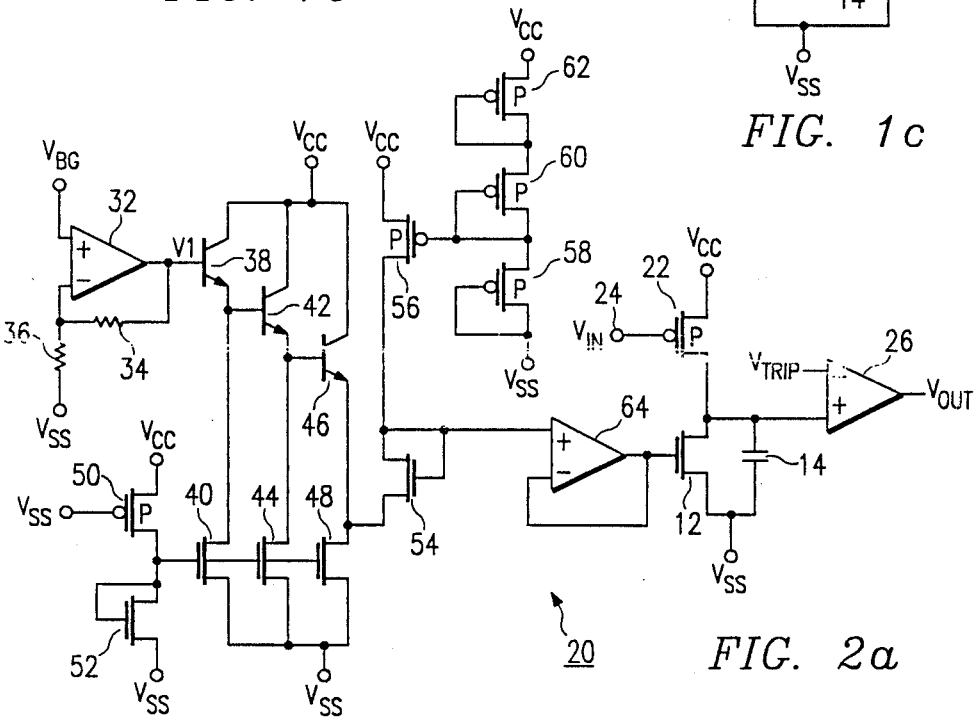
FIG. 2*a* is a schematic diagram of a delay circuit including a bias voltage circuit and a comparator circuit according to the present invention.

Turning now to FIG. 2*a*, the timing circuit including the bias voltage generating circuitry according to the present invention is shown generally as element 20. Included in FIG. 2*a* is FET 12 and capacitor 14 of the basic timing circuit of FIG. 1*a*. The source of FET 12 and first terminal of the capacitor 14 is connected to a reference voltage shown in FIG. 2*a* as $V_{SS}$. The drain of the FET 12 and the second terminal of the capacitor 14 are connected to the drain of a p-channel enhancement-mode pullup FET 22, the gate of which is connected to an input voltage $V_{IN}$ at input terminal 24, and the source of the FET 22 is connected to $V_{CC}$. Also connected to the drain of the FET 12 is the positive input of a voltage comparator 26, the negative input terminal of which is connected to a voltage $V_{TRIP}$. $V_{TRIP}$ is selected to be a voltage equal to approximately one-half that of $V_{CC}$. The output of the comparator 26 provides an output voltage shown as $V_{OUT}$.

The operation of the circuit shown in FIG. 2*a* described so far will be described with reference to FIG. 2*b*. As shown in FIG. 2*b*, when the input voltage $V_{IN}$ is at a logical low voltage level, FET 22 is sufficiently conductive to force the voltage on capacitor 14 to be essentially at $V_{CC}$. (It will be assumed throughout this discussion that $V_{SS}$ is at ground potential relative to the other voltages in the circuit.) It will be appreciated by those skilled in the art that while the FET 12 is also conductive at this time, the relative size ratio between the FET 12 and the FET 22 is such that the FET 22 can supply much more current than the FET 12 can sink. Since the voltage across the capacitor 14 is greater than the voltage at the negative input to the comparator 26, the output of the comparator 26, $V_{OUT}$, is at a logical high voltage level. At time t=0 the input voltage changes from a logical low voltage level to a logical high voltage level, causing the FET 22 to become nonconducting. At this time the voltage on the capacitor 14 begins to discharge through the FET 12 in the manner described above in reference to FIG. 1*a* and FIG. 1*b*. The output of the comparator 26 will remain at a logical high voltage level until the voltage across the capacitor 14 is slightly less than the voltage at the negative input terminal of the comparator 26. When the voltage across the capacitor 14 becomes slightly less than this trip voltage, the output of the comparator 26 will change to a logical low voltage level. In this manner a positive transition in the input voltage is delayed. Later when the input voltage returns to a logical low voltage level, the FET 22 immediately becomes conductive and, because the FET 22 is able to supply a relatively large amount of current to the capacitor 14, quickly charges the capacitor 14 almost to $V_{CC}$. This in turn changes the state of the output voltage $V_{out}$ of the comparator 26. Thus, a negative transition in the input voltage is transferred to the output with only a small, generally negligible, delay.

Turning now to the circuitry for generating the bias voltage driving the gate of the FET 12 in FIG. 2*a*, a noninverting amplifier 32 has its positive or noninverting input connected to a voltage $V_{BG}$, its negative or inverting input connected to the common connection of a feedback resistor 34 and an input resistor 36. The other end of the input resistor 36 is connected to $V_{SS}$, and the other end of the feedback resistor 34 in connected to the output of the amplifier 32. $V_{BG}$ is derived from a band-gap voltage generating circuit not shown in FIG. 2*a*. Band-gap circuits, which are well known in the art, produce a voltage which is stable over temperature. A first bipolar transistor 38 has its base connected to the output of the amplifier 32, its collector connected to $V_{CC}$, and its emitter connected to the drain of a first current source FET 40. A second bipolar transistor 42 has its base connected to the emitter of the transistor 38, its collector connected to $V_{CC}$ and its emitter connected to the drain of a second current source FET 44. A third bipolar transistor 46 has its base connected to the emitter of transistor 42, its collector connected to $V_{CC}$ and its emitter connected to the drain of a third current source FET 48. The sources of the FETs 40, 44 and 48 are connected together and to $V_{SS}$. The gates of the FETs 40, 44 and 48 are connected together and to the common connection of the drains of two series FETs, a p-channel FET 50 and an n-channel FET 52. The source of the FET 50 is connected to $V_{CC}$ and the gate of the FET 50 is connected to $V_{SS}$. The source of the FET 52 is connected to $V_{SS}$ and the gate of the FET 52 is connected to the common connection of the drains of the FETs 50 and 52.

The emitter of the bipolar transistor 46 is connected to the source of a threshold offset FET 54. The drain of the FET 54 is connected to the gate of the FET 54 and to the drain of a current source FET 56. The source of the FET 56 is connected to $V_{CC}$ and the gate of the FET 56 is connected to a node formed by the connection of the source of a first bias FET 58 and the drain of a second bias FET 60. The gate and drain of the first bias FET 58 are connected to $V_{SS}$. The gate of the second bias FET 60 is connected to the drain of the second bias FET 60, and the source of the second bias FET 60 is connected to the drain and gate of a third bias FET 62, the source of which is connected to $V_{CC}$. The current source FET 56 and the bias FETs 58, 60 and 62 are p-channel FETs. Except as stated otherwise all of the FETs shown in FIG. 2*a* are n-channel enhancement mode FETs. Connected to the gate and drain of the threshold offset FET 54 is the positive or noninverting input of a buffer amplifier 64. The negative or inverting input of the buffer amplifier 64 is connected to the output of the buffer amplifier 64 and to the gate of the FET 12, thus completing the bias circuitry. Each of the elements of the bias circuitry is suitable for fabrication in a conventional CMOS integrated circuit.

The bias voltage circuitry just described produces a bias voltage equal to $V_1-K_2V_{be}+V_{th}$. The $V_1$ term is generated by the amplifier 32 together with resistors 34 and 36 and $V_{BG}$. The band gap reference voltage $V_{BG}$ is typically at 2.5 volts and is used instead of $V_{CC}$ because it is essentially independent of temperature and power supply variations. Thus the voltage out of the amplifier 32 is essentially stable and independent of temperature and power supply variations. The FETs 50 and 52 provide a bias voltage for the FETs 40, 44 and 48 which in turn control the current through the bipolar transistors 38, 42 and 46 respectively in order to keep the bipolar transistors operating in their active region. The voltage at the emitter of transistor 38 is one base-emitter voltage drop lower than the voltage at the output of the amplifier 32. Similarly, the voltage at the emitter of the transistor 46 is three base-emitter voltage drops ($3V_{be}$) lower than the voltage at the output of the amplifier 32. The current source FET 56 operates to supply a relatively constant current through the threshold offset FET 54 which is connected to operate in its saturation region. The bias FETs 58, 60 and 62 provide the proper gate voltage to the current source FET 56 to keep it conductive but at a low current level. The voltage at the gate of the threshold offset FET 54 will be one n-channel threshold voltage higher than the voltage at the source of the threshold offset FET 54. Therefore, the voltage at the gate of the threshold offset FET 54 is equal to $V_1-K_2V_{be}+V_{th}$. Since the impedance at the gate of threshold offset FET 54 is high, the gate of FET 12 is susceptible to noise from other portions of the integrated circuit. To alleviate this problem, the buffer amplifier 64 is configured to be unity gain and is used to provide a low impedance voltage source for the gate of the FET 12.

The $V_{th}$ term generated by the bias voltage circuitry will vary from one integrated circuit to another due to processing variations which cause differing transistor characteristics. For a given integrated circuit, however, the threshold voltage of the FET 54 will normally be very close to that of the FET 12. Consequently, if the threshold voltage of the FET 12 is higher or lower than typical, the bias voltage circuitry will generate a correspondingly higher or lower bias voltage, thereby maintaining a constant current through the FET 12 despite variations in threshold voltage from one integrated circuit to another. Thus, the element 20 is self-compensating with respect to integrated circuit processing variations. Similarly, the element 20 is self-compensating with respect to any changes in the threshold voltage of the FET 12 caused by temperature changes or by long-term drift.

Although the invention has been described in part by making detailed reference to a certain specific embodiment, such detail is intended to be and will be understood to be instructive rather than restrictive. It will be appreciated by those skilled in the art that many variations may be made in the structure and mode of operation without departing from the spirit and scope of the invention, as disclosed in the teachings contained herein. For example the conductivity type of the FETs can be changed by making appropriate changes to the supply voltage and gate connections of some of the FETs as will be understood by those skilled in the art. Also the number of bipolar transistors used to create a like number of base-emitter voltage drops may be increased or decreased to provide more or less temperature variation in the bias voltage on the gate of the FET 12. For another alternative, increased accuracy can be achieved by utilizing circuitry for generating $V_{TRIP}$ that maintains $V_{DELTA}$ constant even though $V_{CHARGED}$ might vary somewhat.

What is claimed is:

1. A timing circuit, comprising:
a capacitor;
a first field-effect transistor, comprising a gate, connected to discharge said capacitor;
an additional stage, connected to said capacitor and configured to change state when said capacitor is discharged to a predetermined voltage;
a plurality of bipolar transistors, connected to reduce a temperature-independent reference voltage by a multiple of the base-emitter voltage drop of one of said plurality of bipolar transistors, to provide a temperature-dependent reference potential;
a second field-effect transistor, having source and drain terminals con between a first current source and said temperature-dependent reference potential having a gate connected to said drain terminal thereof;
said gate of said first field-effect transistor being coupled to said gate of said second field-effect transistor so that said gate of said first field-effect transistor receives a voltage corresponding to the voltage on said gate of said second field-effect transistor.

2. The circuit of claim 1 wherein said additional stage consists essentially of a comparator.

3. The circuit of claim 1, wherein said gate of said first field-effect transistor is coupled to said gate of said second field-effect transistor through a buffer amplifier.

4. The circuit of claim 1, wherein said gate of said first field-effect transistor is coupled to the output of a buffer amplifier having unity gain and low source impedance, and the input of said buffer amplifier is connected to said gate of said second field-effect transistor.

5. The circuit of claim 1, wherein said temperature-independent reference voltage is derived from a band-gap voltage reference.

6. The circuit of claim 1, further comprising a switching transistor connected to rapidly charge said capacitor.

7. The circuit of claim 1, further comprising a plurality of second current sources, each of said second current sources being connected to keep a respective one of said bipolar transistors operating in its active region.

8. The circuit of claim 1, wherein a first one of said plurality of bipolar transistors comprises a base, connected to said temperature-independent reference voltage, and an emitter; and a second one of said plurality of bipolar transistors comprises a base, connected to said emitter of said first bipolar transistor.

9. The circuit of claim 1, wherein said plurality of bipolar transistors are NPN transistors.

10. The circuit of claim 1, wherein said plurality of bipolar transistors comprises at least three bipolar transistors, and is connected to reduce the temperature-independent reference voltage by at least three times the base-emitter voltage drop of one of said bipolar transistors, to provide said temperature-dependent reference potential.

11. The circuit of claim 1, wherein said plurality of bipolar transistors comprises exactly three bipolar transistors, and is connected to reduce the temperature-independent reference voltage by exactly three times the base-emitter voltage drop of one of said bipolar transistors, to provide said temperature-dependent reference potential.

12. A timing circuit, comprising:
a capacitor;
a first field-effect transistor, comprising a gate, connected to discharge said capacitor;
an additional stage, connected to said capacitor and configured to change state when said capacitor is discharged to a predetermined voltage;
a bias voltage generating circuit, comprising multiple bipolar transistors and a second field-effect transistor, coupled to said gate of said first field-effect transistor to provide a bias voltage which is equal to:
the sum of
a temperature-independent reference voltage
and the threshold voltage of said second field-effect transistor,
reduced by the combined base-emitter voltage drops of said multiple bipolar transistors.

13. The circuit of claim 12, wherein said additional stage consists essentially of a comparator.

14. The circuit of claim 12, wherein said gate of said first field-effect transistor is connected to receive said bias voltage from a buffer amplifier having unity gain and low source impedance.

15. The circuit of claim 12, wherein said temperature-independent reference voltage is derived from a band-gap voltage reference.

16. The circuit of claim 12, further comprising a switching transistor connected to rapidly charge said capacitor.

17. An integrated circuit, comprising:
at least one timing circuit, comprising:
a capacitor;
a first field-effect transistor, comprising a gate, connected to discharge said capacitor;
a switching transistor connected to rapidly charge said capacitor.
an additional stage, connected to said capacitor and configured to change state when said capacitor is discharged to a predetermined voltage;
wherein the gate of said first field-effect transistor is connected to receive a bias voltage which is equal to:
the sum of
a temperature-independent reference voltage
and the threshold voltage of said second field-effect transistor,
reduced by the combined base-emitter voltage drops of said multiple bipolar transistors;
said timing circuit being connected so that the leading edge of an incoming pulse will turn on said switching transistor, and the trailing edge of the incoming pulse will turn off said switching transistor;
whereby said timing circuit will add a precisely predetermined delay onto the trailing edge of each said pulse.

18. The circuit of claim 17, wherein said additional stage consists essentially of a comparator.

19. The circuit of claim 17, wherein said gate of said first field-effect transistor is connected to receive said bias voltage from a buffer amplifier having unity gain and low source impedance.

20. The circuit of claim 17, wherein said temperature-independent reference voltage is derived from a bandgap voltage reference.

21. A timing circuit, comprising:

a capacitor;

a first field-effect transistor, comprising a gate, connected to discharge said capacitor;

a switching transistor connected to rapidly charge said capacitor;

a comparator, connected to said capacitor;

a plurality of bipolar transistors, connected to reduce a bandgap-derived reference voltage by a multiple of the base-emitter voltage drop of one of said plurality of bipolar transistors, to provide a temperature-dependent reference potential;

a plurality of first current sources, each of said second current sources being connected to keep a respective one of said bipolar transistors operating in its active region;

a second field-effect transistor, having source and drain terminals connected between a second current source and said temperature-dependent reference potential, and having a gate connected to said drain terminal thereof;

said gate of said first field effect transistor being coupled to said gate of said second field-effect transistor so that said gate of said first field-effect transistor receives a voltage corresponding to the voltage on said gate of said second field-effect transistor.

* * * * *